United States Patent [19]

Robertson et al.

[11] 4,079,191

[45] Mar. 14, 1978

[54] ELECTRICAL WIRE FOR USE IN NUCLEAR GENERATING STATIONS

[75] Inventors: A. Bruce Robertson, Succasunna; Elmer C. Lupton, Jr., Chatham, both of N.J.

[73] Assignee: Allied Chemical Corporation, Morris Township, N.J.

[21] Appl. No.: 593,811

[22] Filed: Jul. 7, 1975

[51] Int. Cl.[2] ..... H01B 7/02

[52] U.S. Cl. ..... 174/121 SR; 174/110 FC; 174/121 R; 174/121 A; 427/118

[58] Field of Search ..... 174/110 FC, 120 R, 120 SR, 174/121 R, 121 SR, 110 C, 121 A; 427/118

[56] References Cited

U.S. PATENT DOCUMENTS

| | | | |
|---|---|---|---|
| 2,691,694 | 10/1954 | Young | 174/110 FC |
| 2,949,150 | 8/1960 | Traynor | 174/121 R |
| 3,101,845 | 8/1963 | Heasley | 174/120 R |
| 3,168,417 | 2/1965 | Smith | 427/118 |
| 3,425,865 | 2/1969 | Shelton | 174/121 R |
| 3,453,373 | 7/1969 | Yamamoto | 174/121 R |
| 3,823,255 | 7/1974 | La Gase | 174/121 A |

OTHER PUBLICATIONS

Halar Bulletin W Form #854–156, 9/72, Allied Chemical N.J. Brochure.

Dupont Tefzel Brochure, Dupont Co., Wilmington, Del., 6/70.

*Primary Examiner*—E. A. Goldberg

*Attorney, Agent, or Firm*—Jay P. Friedenson; Roger H. Criss

[57] ABSTRACT

Electrical wire and cable suitable for use in nuclear generating stations, having at least one electrical conductor, a micaceous insulating layer surrounding the conductor and a layer of fluoropolymer insulation surrounding the micaceous layer.

8 Claims, 2 Drawing Figures

ELECTRICAL WIRE FOR USE IN NUCLEAR GENERATING STATIONS

BACKGROUND OF THE INVENTION

1. Field of the Invention

This invention relates to insulated electrical wire and cable useful in nuclear generating stations, as well as in other applications.

2. Description of the Prior Art

Electrical wire and cable suitable for use in nuclear power generating stations must be designed to withstand extremely severe conditions. Such wire and cable, referred to hereafter simply as cable, are useful for power, control and instrumentation services provided in proximity to, but not within, the reactor vessel. The extreme conditions which such cable must withstand include normal conditions as well as extraordinary conditions, such as accidents and the like. Under normal conditions, the cable must be suitable for operation at reactor full-load ambient temperature, radiation and atmospheric conditions and normal electrical and physical stresses for its installed life. Extraordinary conditions are known as design basis events (DBE), which are postulated abnormal events employed in the design of the reactor to establish the performance requirements of structures and systems, and include loss-of-coolant accident (LOCA) and fires. The cable must be capable, either early or late in its normal design life, of operating through postulated environmental conditions, including wet and radiation environments, resulting from LOCA. Conditions of loading and signal levels during LOCA testing are assumed to be those most unfavorable for cable operation which may be anticipated under such circumstances. In addition, the cable should be fire retardant with respect to propagation under conditions of installation. Performance during a fire is related to those conditions which would extend the influence of the fire to cables of redundant systems.

It is critical that cable intended for so-called Class IE electrical equipment (that is, equipment that is essential to the safe shut-down and isolation of the reactor or whose failure or damage could result in significant release of radioactive material) withstand the operating conditions mentioned above. To be useful in such installation, the cable should meet standards generated by the Institute of Electrical and Electronics Engineers, known as IEEE Standard 383. Heretofore, it has been suggested that in view of their excellent chemical resistance and electrical properties, the fluoropolymer resins, such as a copolymer of ethylene and chlorotrifluoroethylene be employed as insulation for nuclear power cables. However, it has been found that cables provided with ethylene-chlorotrifluoroethylene copolymer primary insulation do not meet the rigid LOCA requirements of IEEE Standard 383 when tested at 600 volts for use as power or control cables, although they do meet such requirements when tested at 300 volts.

SUMMARY OF THE INVENTION

In accordance with this invention, electrical wire and cable ("cable") are provided which comprise at least one electrical conductor, a micaceous insulating layer surrounding the conductor and a layer of fluoropolymer insulation surrounding the micaceous layer. It has been found that such cable meets the LOCA requirements of IEEE Standard 383 pertaining to use in nuclear generating stations. This result is surprising since it would be expected that the micaceous layer, which is of a porous nature, would decrease the electrical insulating resistance of the composite cable when exposed to such penetrating materials as water and steam. The fact that superior insulating results are obtained over cable merely coated with the fluoropolymer primary insulation is truly surprising. In addition, the cable of this invention has excellent long term wet environment properties.

DESCRIPTION OF THE PREFERRED EMBODIMENTS

Figure 1:
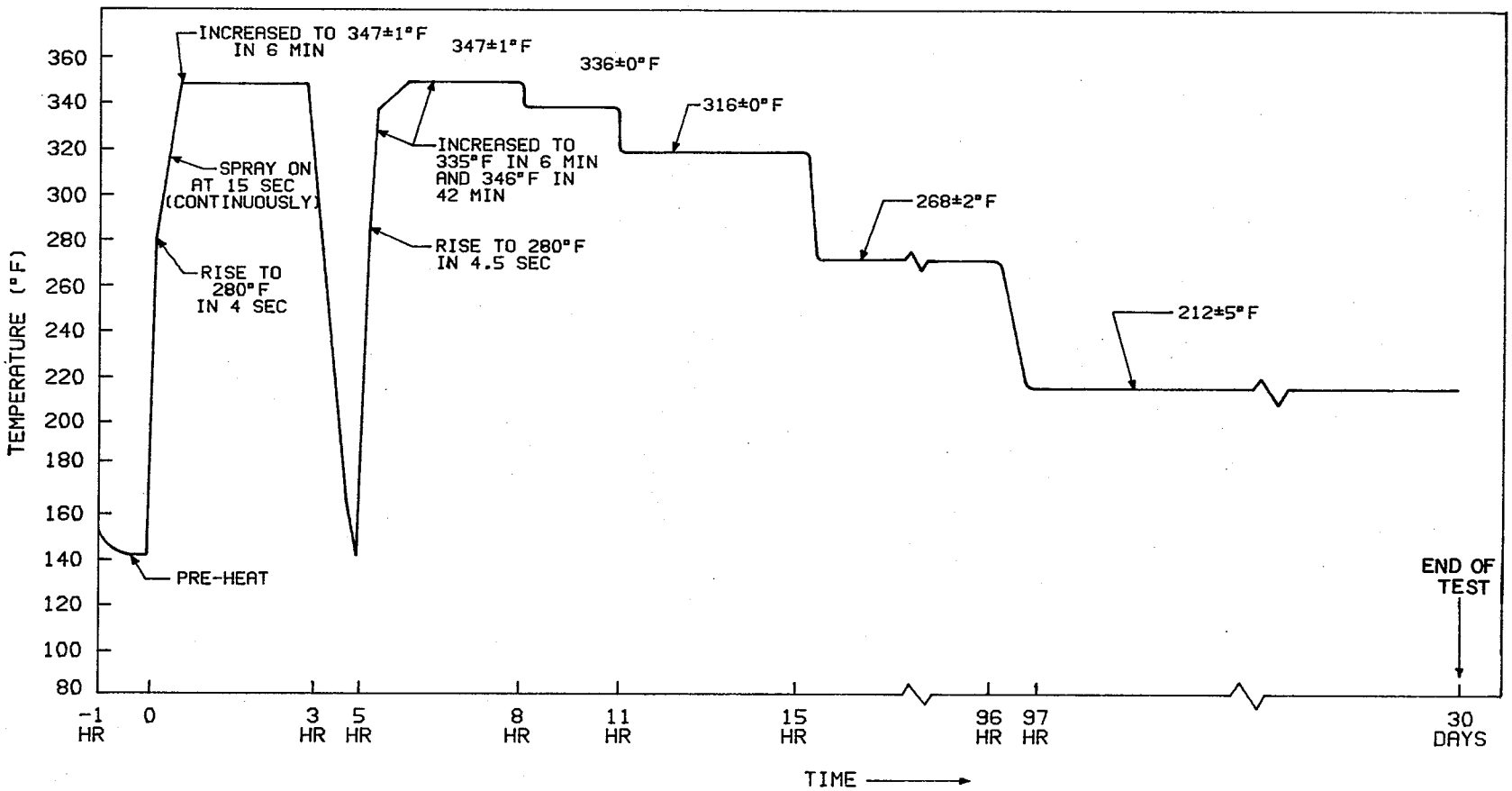
FIG. 1 is a graph of the temperatures employed during the steam/chemical spray exposure test in connection with the IEEE Standard 383 DBE-LOCA test described below.
Figure 2:
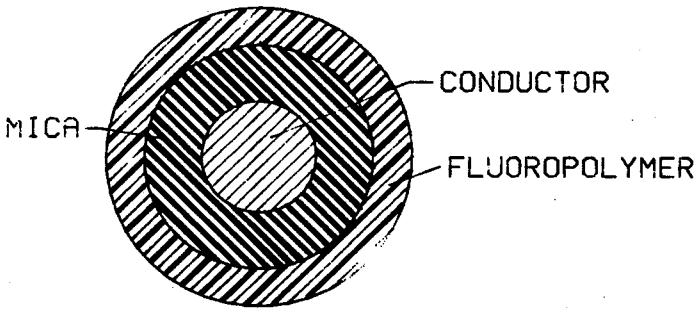
FIG. 2 is a cross-sectional view of the electrical cable of this invention.

In accordance with the preferred embodiments of this invention, an electrical cable is provided with a primary insulation of micaceous material and a secondary insulation of a fluoropolymer. The cable itself may comprise one or more electrical conductors formed of any suitable metal, preferably copper or aluminum. The cable may be in any suitable size, such as 8 to 20 American Wire Gauge (AWG), preferably 14 to 20 AWG. The individual conductors may be individually provided with both primary and secondary insulation layers before being formed into a composite cable or the individual conductors may be combined before or after wrapping with the primary insulation and prior to applying the secondary layer thereon. Preferably, single conductors are employed which are provided with the primary and secondary layers.

The primary layer is composed of a micaceous material. Preferably, this layer is in the form of a mica paper tape and is wrapped about the bare cable by conventional cable taping equipment or by direct feed into extrusion heads. The mica tape may, for example, have a thickness of about 0.5 to about 50 mils, more preferably about 3 to about 5 mils.

The fluoropolymer secondary insulation may be applied to the covered conductor by any suitable manner including extrusion coating, powder coating and the like. The extrusion of the fluoropolymer onto the primary insulation is preferred since high rates of production can be obtained. In general, the fluoropolymer employed should have adequate radiation resistance for utilization in nuclear generating stations. Preferred fluoropolymers are copolymers of ethylene and chlorotrifluorethylene (ECTFE) and copolymers of ethylene and tetrafluoroethylene (ETFE). Such copolymers may also contain minor amounts (e.g., up to about 15 mol %) of other comonomers; for example, a terpolymer of ethylene, chlorotrifluoroethylene and hexafluoroisobutylene may be used. Especially preferred fluoropolymers are approximately equimolar copolymers of ECTFE or ETFE. Other fluoropolymers that may be employed include tetrafluoroethylene homopolymers and copolymers with hexafluoropropene, propylene or perfluorovinylpropyl ether, chlorotrifluoroethylene homopolymers and copolymers with various alkenes, vinylidene fluoride homopolymers and copolymers with hexafluoroisobutylene, and the like.

The fluoropolymer layer may also include conventional additives, such as stabilizers, fillers, pigments and the like. The thickness of the fluoropolymer layer may be in the range of about 5 to 100 mils or more, preferably about 10 to 20 mils.

To further illustrate the features of this invention, the following non-limiting examples are given.

EXAMPLE 1

600 Volt copper electrical switchboard cable of 14 AWG was hand-wrapped with 3.5 mil thickness of a mica paper tape sold under the designation 77925 Mica Paper Cable Tape by General Electric Company. The tape had the following properties:

| Property | Number |
|---|---|
| Tensile strength, average | |
| lb/in width, MD | |
| — to mica fracture | 25 |
| — final tape break | 75 |
| Elmendorf tear strength, average | |
| grams - MD | 45 |
| grams - XMD | will not tear |
| Elongation, % - average | |
| — to mica fracture | <0.4 |
| — to final break | <3 |
| Dielectric strength - V.P.M. - average | |
| RT, S.T. - ¼ in. electrodes | 1100 |
| RT, Catch Lap | |
| 0.020–0.025 in. build | 500 |

The cable wrapped with the mica tape was coated with a copolymer of ECTFE sold under the designation HALAR$^R$ fluoropolymer grade 300 by Allied Chemical Corporation. The ECTFE had a melt index of about 1 to 4 and was applied by an extrusion coating machine of the tubeon type which melted the material to a temperature of about 520° F. The ECTFE was applied as a continuous and pinhole-free coating of about 15 mils thickness on the mica tape.

The composite cable was thermally aged 500 hours at 160° C. in a circulating, hot air oven and thereafter exposed to gamma radiation from a cobalt-60 source to an accumulated, equivalent-air dose of 200 megarads. The aging and accident radiation doses were combined into a 200-megarad exposure and the radiation dose rate was 1.0 megarad per hour for a period of 200 hours. The cable was rotated and turned during exposure to obtain even dose distribution.

The cable was placed inside a pressure vessel on a perforated metal shelf that simulated a cable tray. The ends of the cable were passed through connectors on flanges in the vessel wall, where sealing was effected by rubber grommets that were compressed on the individual conductor insulation. Steel basket-weave cable grips prevented the cable from slipping through the seal during high-pressure portions of the test. Spray nozzles were positioned above the cable so that a uniform spray pattern was established over the cable.

The cable was energized with 600 volts AC at a current load of 20 amp during steam and chemical spray exposure. The cable was continuously sprayed for 30 days with an 0.28 molar solution of boric acid (3000 ppm boron), buffered with sodium hydroxide to a pH between 9 and 11 at 77° F. The spray was directed downward onto the samples at a nominal rate of 0.15 gpm/ft$^2$ over a horizontal area that included all of the cable. The cable was exposed to elevated temperature during the spray exposure that included two transients to 346° F., each followed by three hour dwells at such temperature. The temperature/pressure profile is shown in the Figure.

Insulation resistance measurements were made before, during and after the steam/chemical spray exposure and are given in Table I under Cable 1. The cable met the requirements of the LOCA test. At the conclusion of the test program, a high-potential withstand test was conducted with the cable wrapped around a mandrel having a diameter 40 times the cable diameter. After at least six turns of the cable were placed around the mandrel, it was immersed (except for the cable ends) in tap water at room temperature for one hour. The cables were then subjected to a 5 minute high-potential (hi-pot) withstand test. The test potential was 1.2 kilovolts AC and the leakage and charging current after 5 minutes was one milliampere. After the successful completion of the hi-pot test, the test voltage was increased until the charging and leakage current reached the instrument limit (10 milliamperes); the voltage at this point was 6.0 kilovolts AC.

At the conclusion of the steam/chemical spray exposure test, the cable was moderately flexible although there were some chemical deposits that rubbed off easily. The twisted wrapping of the conductor produced a visible impression of the insulation of the cable.

EXAMPLE 2

Example 1 was repeated with the following exceptions. The cable was a single conductor 16 AWG, 300 volt instrumentation cable and was provided with a 15 mil coating of ECTFE copolymer in accordance with Example 1. No micaceous layer was employed. During the steam/chemical spray exposure, the cable was energized at 20 amperes to 300 volts AC. The results are shown in Table I under Cable 2. The insulation appeared rust colored. Although the single conductor passed the LOCA test, its small potential load of 300 volts restricted its application to instrument cable for use in nuclear generating stations. The cable was subjected to a hi-pot test at 1.6 kilovolts AC and the leakage was less than 1 milliamp; the voltage at 10 milliamp was 7.5 kilovolts AC.

EXAMPLE 3

Example 2 was repeated except that the cable was energized to 600 volts. The results are shown in Table I under Cable 3. The insulation resistance fell below $0.5 \times 10^5$ ohms and thus was inadequate under the LOCA test. This example demonstrates that cable having a 15 mil coating of ECTFE copolymer is not suitable for use as power and control cable of at least 600 volts in nuclear generating stations.

EXAMPLES 4–8

Example 1 was repeated with the following cable constructions.

Example 4 was a 12 AWG, 600 volt single conductor coated with 20 mils of cross-linked ECTFE copolymer. The copolymer was cross-linked after application to the cable by electron beam (beta) radiation at 10 megarads. Example 5 was a 14 AWG, 600 volt single conductor coated with 15 mils of cross-linked ECTFE copolymer. Example 6 was a 14 AWG, 600 volt conductor having a hand-wrapped 3.5 mil layer of the same mica tape employed in Example 1 and a 15 mil layer thereover of cross-linked ECTFE copolymer. Example 7 was a 12 AWG, 300 volt single conductor coated with 15 mils of cross-linked ECTFE copolymer. Example 8 was a 14 AWG, 600 volt, 7 conductor cable having a coating of 15 mils of ECTFE copolymer. The results are shown in Table I under Cables 4–8 respectively.

It can be seen from Table I that each of Cables 4–8 did not pass the insulation resistance test as indicated by their electrical resistance of less than $0.5 \times 10^5$ ohms.

It is surprising that the cross-linked ECTFE cable constructions (Cables 4–7) exhibited significantly inferior electrical resistance under the LOCA test than non-cross-linked ECTFE (Cable 1). Previously, it was believed that such cross-linked material would increase the electrical resistance. Accordingly, for use as nuclear cable, the fluoropolymer should not be a cross-linkable composition since it appears that presently employed additives in such compositions promote the degradation of the electrical properties of the ECTFE insulation in high pressure steam environments.

EXAMPLE 9 wire was about one inch from the top of the burner and flames were visible about four inches above the top of the burner. The insulation resistance was measured over a period of time. The example was repeated and the results are shown in Table 2 under Samples 1 and 2.

The test was repeated with a bunsen burner (yellow flame) which provided a colder flame than the Meeker burner. The results are shown in Table II under Sample 3.

As can be seen from Table II, the insulation resistance, which was initially infinite, decreased after 1.5 to minutes for Samples 1 and 2 and then increased to high levels after about an hours flame exposure. Sample 3 retained its infinite resistance for a longer period of time and then dropped off. These results demonstrate that the wire constructions of this invention have excellent flame resistance and electrical insulation-under-flame properties.

TABLE I

| Elapsed Time (hr)[1] | Temp. (° F) | Pressure (psig) | Insulation Resistance - (ohm)[2] | | | | | | | |
|---|---|---|---|---|---|---|---|---|---|---|
| | | | Cable 1 | Cable 2 | Cable 3 | Cable 4 | Cable 5 | Cable 6 | Cable 7 | Cable 8 |
| −2.0 | 82 | 0 | $1.4\times10^{10}$ | $3.5\times10^{11}$ | $3.1\times10^{11}$ | $3.5\times10^{11}$ | $4.0\times10^{11}$ | $3.3\times10^{11}$ | $2.0\times10^{10}$ | $2.0\times10^{9}$ |
| 1.65 | 346 | 120 | $1.0\times10^{9}$ | $0.52\times10^{8}$ | $<0.5\times10^{5}$a | $0.75\times10^{8}$ | $4.6\times10^{6}$ | $0.94\times10^{7}$ | $1.9\times10^{8}$ | $2.6\times10^{6}$ |
| 6.6 | 346 | 120 | $1.0\times10^{9}$ | $4.5\times10^{7}$ | " | $0.68\times10^{8}$ | $1.05\times10^{6}$ | $4.0\times10^{7}$ | $2.6\times10^{8}$ | $0.97\times10^{6}$ |
| 9.6 | 335 | 102 | $1.3\times10^{9}$ | $0.66\times10^{8}$ | " | $0.98\times10^{8}$ | $1.9\times10^{6}$ | $0.92\times10^{8}$ | $4.3\times10^{8}$ | $1.07\times10^{6}$ |
| 12.9 | 315 | 74 | $2.4\times10^{9}$ | $1.3\times10^{8}$ | " | $2.3\times10^{8}$ | $1.6\times10^{6}$ | $1.9\times10^{8}$ | $0.85\times10^{8}$ | $2.5\times10^{6}$ |
| 15.8 | 265 | 26 | $1.9\times10^{10}$ | $1.8\times10^{9}$ | " | $1.1\times10^{9}$ | $1.6\times10^{6}$ | $0.75\times10^{9}$ | $4.5\times10^{6}$ | $4.0\times10^{7}$ |
| 49.9 | 266 | 27 | $2.0\times10^{10}$ | $2.2\times10^{9}$ | $1.5\times10^{5}$b | $1.5\times10^{9}$ | $2.2\times10^{6}$ | $0.7\times10^{9}$ | $1.0\times10^{8}$ | $4.0\times10^{7}$ |
| 96.2 | 266 | 28 | $2.1\times10^{10}$ | $2.6\times10^{9}$ | $3.0\times10^{5}$b | $1.7\times10^{9}$ | $0.78\times10^{7}$ | $0.72\times10^{9}$ | $0.8\times10^{8}$ | $4.2\times10^{7}$ |
| 97.6 | 210 | 2 | $1.25\times10^{11}$ | $2.1\times10^{11}$ | $3.0\times10^{5}$a | $1.8\times10^{11}$ | $1.1\times10^{9}$ | $0.8\times10^{11}$ | $4.2\times10^{7}$ | $1.32\times10^{9}$ |
| 186.2 | 215 | 3.5 | $1.6\times10^{11}$ | $2.7\times10^{11}$ | $<0.5\times10^{5}$a | $2.5\times10^{11}$ | $5.0\times10^{6}$ | $1.5\times10^{9}$ | $<0.5\times10^{5}$a | $2.6\times10^{9}$ |
| 236.7 | 210 | 1 | $1.15\times10^{11}$ | $2.2\times10^{11}$ | " | $<0.5\times10^{5}$a | $3.0\times10^{6}$ | $<0.5\times10^{5}$a | " | $2.5\times10^{9}$ |
| 336.6 | 208 | 3.5 | $0.64\times10^{11}$ | $0.73\times10^{12}$ | " | " | $<0.5\times10^{5}$a | " | " | $3.2\times10^{9}$ |
| 406.7 | 212 | 2.5 | $1.8\times10^{11}$ | $0.56\times10^{12}$ | " | " | " | " | " | $<0.5\times10^{5}$a |
| 505.7 | 212 | 2.5 | $2.4\times10^{9}$ | $4.7\times10^{11}$ | " | " | " | " | " | $0.6\times10^{9}$ |
| 570.3 | 212 | 1.5 | $1.4\times10^{9}$ | $1.1\times10^{11}$ | " | " | " | " | " | $<0.5\times10^{5}$a |
| 722.4 | 215 | 2 | $0.6\times10^{9}$ | $2.4\times10^{11}$ | " | " | " | " | " | $1.53\times10^{9}$ |
| 738.2 | 84 | 0 | $5.0\times10^{9}$ | $6.4\times10^{12}$ | $0.7\times10^{6}$ | $0.62\times10^{6}$ | $3.75\times10^{5}$c | $3.4\times10^{5}$ | $1.3\times10^{6}$ | $3.1\times10^{9}$ |

[1]Time from beginning of steam/chemical-spray exposure
[2]Values read after application of 500 Vdc for 1 minute, except that: a — 10Vdc; b — 90Vdc; c — 100Vdc

TABLE II

| Time, Min. | Resistance, ohms | | | | | | | |
|---|---|---|---|---|---|---|---|---|
| | Sample 1 | Sample 2 | Sample 3 | Sample 4 | Sample 5 | Sample 6 | Sample 7 | Sample 8 |
| 0 | ∞ | ∞ | ∞ | ∞ | ∞ | ∞ | ∞ | ∞ |
| 0.25 | | | | | | | ∞ | |
| 0.5 | ∞ | ∞ | ∞ | ∞ | $1.5\times10^{6}$ | Dead short[c] | Dead short[d] | ∞ |
| 1 | $2\times10^{7}$ | ∞ | ∞ | Dead short[a] | Dead short[b] | | | ∞ |
| 1.5 | $4\times10^{4}$ | ∞ | ∞ | | | | | Dead short[e] |
| 2 | $2\times10^{4}$ | $6\times10^{5}$ | ∞ | | | | | |
| 3 | $6\times10^{3}$ | $6\times10^{4}$ | ∞ | | | | | |
| 4 | $7.5\times10^{3}$ | $3\times10^{4}$ | ∞ | | | | | |
| 5 | $1\times10^{4}$ | $4\times10^{4}$ | $2\times10^{7}$ | | | | | |
| 7 | | | $5\times10^{6}$ | | | | | |
| 10 | | $1\times10^{6}$ | $1\times10^{6}$ | | | | | |
| 15 | | | $1.5\times10^{5}$ | | | | | |
| 20 | | $3\times10^{6}$ | $1.5\times10^{5}$ | | | | | |
| 30 | | $1\times10^{7}$ | | | | | | |
| 50 | | $2\times10^{7}$ | | | | | | |
| 60 | | | $1.5\times10^{5}$ | | | | | |
| 77 | ∞ | | | | | | | |

[a]=58 sec.
[b]=37 sec.
[c]=27 sec.
[d]=28 sec.
[e]=68 sec.

14 AWG copper wire having a primary insulation of mica paper tape and a secondary insulation of ECTFE, prepared as in Example 1, was subjected to a Horizontal Twisted Pair Flame Test to determine its electrical resistance when exposed to flame. Under this test, the wire was stripped at both ends and cut in the middle into two pieces. The pieces were twisted together and the stripped ends were connected to a Simpson Model 260 Series 6P ohmmeter using the R × 10,000 scale. The twisted pair was placed on a ring stand above a Meeker burner (blue flame) so that the bottom of the

EXAMPLE 10 (COMPARATIVE)

Example 9 was repeated except that the wire was only coated with 15 mils of ECTFE resin as in Example 2 and a bunsen burner (yellow flame) was employed. The results are reported in Table II as Sample 4. As can be seen, this construction resulted in a dead short (resistance of 0 ohms) after only 58 seconds, indicating that the flame resistance and electrical insulation-under-flame properties were substantially poorer than in Example 9.

EXAMPLE 11 (COMPARATIVE)

Example 10 was repeated except that the wire was a 12 AWG copper wire. The results are shown in Table II under Samples 5–8. For Samples 5–7, a Meeker burner was used and for Sample 8, a bunsen burner. The results demonstrate that even in this thicker gauge, the wire dead shorted in a very short period of time, indicating substantially poorer flame resistance and electrical insulation-under-flame properties than in Example 9.

It is to be understood that variations and modifications of the present invention may be made without departing from the scope of the invention. It is also to be understood that the scope of the invention is not to be interpreted as limited to the specific embodiment disclosed herein, but only in accordance with the appended claims when read in light of the foregoing disclosure.

We claim:

1. Electrical cable suitable for use in nuclear generating stations comprising at least one electrical conductor, a micaceous layer in contact with and surrounding said conductor and a layer comprising a non-cross-linked copolymer of ethylene and chlorotrifluoroethylene in contact with and surrounding said micaceous layer.

2. The electrical cable of claim 1 wherein said micaceous-layer has a thickness of about 0.5 to 50 mils.

3. The electrical cable of claim 1 wherein said non-cross-linked copolymer layer has a thickness of about 5 to 100 mils.

4. The electrical cable of claim 1 wherein said micaceous layer is a mica paper tape which has a thickness of about 3 to 5 mils and said non-cross-linked copolymer layer has a thickness of about 10 to 20 mils.

5. The electrical cable of claim 1 wherein said non-cross-linked copolymer is an approximately equimolar copolymer.

6. The electrical cable of claim 5 wherein said conductor is a single conductor.

7. The electrical cable of claim 1 wherein said conductor is a single conductor.

8. The electrical cable of claim 1 wherein said micaceous layer comprises a mica paper tape.

* * * * *